US010465150B2

(12) United States Patent
Somerville Roberts et al.

(10) Patent No.: US 10,465,150 B2
(45) Date of Patent: Nov. 5, 2019

(54) CLEANING COMPOSITION

(71) Applicant: The Procter & Gamble Company, Cincinnati, OH (US)

(72) Inventors: Nigel Patrick Somerville Roberts, Newcastle upon Tyne (GB); Julie Ellis, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 80 days.

(21) Appl. No.: 15/585,189

(22) Filed: May 3, 2017

(65) Prior Publication Data

US 2017/0321170 A1 Nov. 9, 2017

(30) Foreign Application Priority Data

May 3, 2016 (EP) ..... 16168212

(51) Int. Cl.

| | |
|---|---|
| ***C11D 3/08*** | (2006.01) |
| ***C11D 3/34*** | (2006.01) |
| ***C11D 3/37*** | (2006.01) |
| ***C11D 11/00*** | (2006.01) |
| ***C11D 3/12*** | (2006.01) |
| ***C11D 3/20*** | (2006.01) |
| ***C11D 17/06*** | (2006.01) |
| ***C11D 17/00*** | (2006.01) |

(52) U.S. Cl.

CPC ..... *C11D 11/0023* (2013.01); *C11D 3/08* (2013.01); *C11D 3/122* (2013.01); *C11D 3/1246* (2013.01); *C11D 3/2086* (2013.01); *C11D 3/3707* (2013.01); *C11D 3/3769* (2013.01); *C11D 3/3776* (2013.01); *C11D 11/0088* (2013.01); *C11D 17/0034* (2013.01); *C11D 17/06* (2013.01)

(58) Field of Classification Search

CPC ..... C11D 3/08; C11D 3/122; C11D 3/124; C11D 3/34; C11D 3/3776; C11D 3/3769

See application file for complete search history.

(56) References Cited

U.S. PATENT DOCUMENTS

| | | | | |
|---|---|---|---|---|
| 5,856,164 | A | 1/1999 | Outtrup et al. | |
| 6,093,562 | A | 7/2000 | Bisgard-Frantzen et al. | |
| 2005/0113280 | A1* | 5/2005 | Reddy | C11D 3/0036 510/475 |
| 2008/0193999 | A1 | 8/2008 | Andersen et al. | |
| 2016/0010033 | A1* | 1/2016 | Tan | C11D 3/046 510/356 |
| 2016/0186099 | A1 | 6/2016 | Geny et al. | |

FOREIGN PATENT DOCUMENTS

| | | | |
|---|---|---|---|
| DE | 10 2006 021553 | A1 | 8/2007 |
| EP | 0 368 137 | A1 | 5/1990 |
| WO | WO 96/23873 | A1 | 8/1996 |
| WO | WO 99/23211 | A1 | 5/1999 |
| WO | WO 00/60060 | A2 | 10/2000 |
| WO | WO 2009/156233 | A1 | 12/2009 |

OTHER PUBLICATIONS

International Search Report; International Application No. PCT/US2017/030746; dated Jul. 27, 2017; 11 pages.

* cited by examiner

*Primary Examiner* — Brian P Mruk
(74) *Attorney, Agent, or Firm* — John T. Dipre

(57) ABSTRACT

A cleaning composition comprising a particle said particle comprising: (a) from 30 to 70% by weight thereof of a polymer having a softening point in the range from about 20° C. to about 60° C.; (b) from 20 to 60% by weight thereof of a first material having a BET surface area greater than 100 m2/g and a D50 from about 5 to about 20 μm; (c) from 3 wt % to 15% by weight thereof of a second material having a BET surface area from about 0.01 to about 5 m2/g and a D50 from about 30 to about 100 μm.

7 Claims, No Drawings

CLEANING COMPOSITION

FIELD OF THE INVENTION

The present invention is in the field of cleaning. In particular, it relates to a cleaning composition comprising a particle, the particle comprises a high level of a polymer, the polymer having relatively low softening point. The particle presents good physical properties and processability and is particularly suitable for use in automatic dishwashing compositions.

BACKGROUND OF THE INVENTION

The use of polymers in cleaning compositions is known. The processing and incorporation of polymers in cleaning compositions can be challenging, especially if the polymers are synthesized in aqueous solutions and the solutions are low active, i.e., the solutions contain a low level of polymer. Low active solutions are not suitable for use in concentrated products or unit dose products where space is limited. In the case of liquid cleaning compositions there can be incompatibility between the aqueous solution containing the polymer and the rest of the liquid cleaning composition, they can have different density and/or viscosity and give rise to stability issues.

Often, the polymers can be waxy, ductile, deformable, sticky materials depending on the environmental conditions. The physical properties can make polymers difficult to incorporate into cleaning compositions or they can be instable during manufacturing and/or in cleaning compositions under a range of different environmental conditions, such as temperature, humidity, etc. Another consideration in the cases of polymers for use in cleaning compositions, is that they need to be readily available for cleaning and have the right dissolution profile.

Polymers with a low softening point can be difficult to handle or unsuitable for certain types of process such as spray dry, extrusion, etc.

The object of the present invention is to provide a way to incorporate low softening point polymers into cleaning compositions. The polymer needs to be stable in the cleaning composition and be readily available to perform its role in the cleaning composition.

SUMMARY OF THE INVENTION

According to the first aspect of the invention, there is provided a cleaning composition. Preferably, the composition is an automatic dishwashing composition. The cleaning composition comprises a particle. The particle comprises:

(a) from 30 to 70% by weight of the particle of a polymer. The polymer has a softening point in the range from about 20° C. to about 60° C.;

(b) from 30 to 60% by weight of the particle of a first material. The first material having a BET surface area greater than 150 m2/g and a D50 in the range from about 5 to 20 μm;

(c) from 3 to 15% by weight of the particle of a second material. The second material having a BET surface area from about 0.01 to about 5 m2/g and a D50 in the range from about 30 to about 100 μm.

The particle is robust, it has higher softening point than the polymer, and presents good flowability and stability in cleaning compositions, in particular in automatic dishwashing cleaning compositions.

The particle has a dissolution profile suitable for automatic dishwashing and does not leave residues on the washed tableware.

The particle of the composition of the invention, is sometimes herein referred to as "the particle of the invention".

According to the second aspect of the invention, there is provided a process for making the composition of the invention. The process is energy efficient because the starting polymer solution for making the particle is high active and it does not required long drying time or high drying temperatures.

The elements of the composition described in connection with the first aspect of the invention apply mutatis mutandis to the second aspect of the invention.

DETAILED DESCRIPTION OF THE INVENTION

The present invention encompasses a cleaning composition comprising a particle comprising a polymer. The polymer has low softening point. The polymer is usually synthesized in the form of an aqueous solution and it is not suitable to be used directly in a cleaning composition. Processing aids can be used in order to make the polymer suitable for use in a cleaning composition. However, not all the processing aids are compatible with the polymer due to its chemical properties or not all the processing aids are suitable for use in cleaning compositions. For example, processing aids that can deposit on cleaned items cannot be used. This is especially relevant in the case of automatic dishwashing cleaning compositions. When designing a particle to be used in a cleaning composition the speed of dissolution also needs to be considered.

The particle of the invention comprises a first material having a high polymer loading capacity, i.e. it has the capacity to contain a high amount of polymer and a second material having a low polymer loading capacity. If only the polymer and the first material are used to make the particle then the resulting particle is not very robust and crumbles easily being incapable of standing the handling during manufacture. Without being bound by theory, it is believed that the first material carries the polymer and the second material bind particles of the first material loaded with the polymer to make the final particle. The particle has a higher softening point than the polymer.

The invention also encompasses a process for making the cleaning composition comprising the particle.

The Polymer

The polymer used in the particle of the invention, sometimes referred herein as "the polymer of the invention" has a softening point in the range from about 20° C. to about 60° C., preferably from about 25° C. to about 55° C. The term "softening point" relates to an increase in molecular mobility when the temperature increases. The polymer goes from being a hard material easy to process to a ductile, deformable and often viscoelastic solid or liquid. With DSC, the softening point is identified as an endothermic event on the heat flow while heating; with the baseline having the same heat flow before and after the event Polymers tend to exhibit a temperature range for their softening response. The softening point is defined in this application as the onset temperature of the endothermic event on the heat flow while heating.

The softening point is measured using differential scanning calorimeter (DSC). DSC is a technique used to study what happens to polymers when they are heated, allowing the identification of thermal transitions of a polymer. The DSC measures the difference of heat flow between a study sample and a reference pan as a function of time and temperature, to run this technique a commercially available differential scanning calorimeter can be used (such as Q2000 DSC from TA Instruments UK, Elstree, Herts, United Kingdom) with an accompanying software (such as Platinum software).

Using tweezers, the polymer samples (approximately 8 mg) are weighed on a sample pan (such as a Tzero™ aluminum pan provided by TA Instruments UK, Elstree, Herts, United Kingdom) using a balance (such as AT261 from Mettler-Toledo Ltd., Leicester, United Kingdom) the sample weight is recorded. Using tweezers the sample pans are placed onto the autosampler. The reference pan should contain no sample, but should be the same pan type as the sample.

In the first part of the DSC measurement, the sample is conditioned by equilibrating the sample to 80° C. and keeping it for 60 minutes in dry nitrogen gas. The conditioned sample is ramped from 80° C. to 10° C. at 5° C./min. At 10° C. is hold isothermally for 2 mins before ramping for 10° C. to 100° C. at 5° C./min.

Once the analysis has been completed a chart of heat flow against temperature is drawn using the TA Universal analysis software, the softening point is seen as an endothermic event on the heat flow temperature. With polymers where the softening range is broad, the softening point for each sample is then reported as the onset of the endothermic event rather than the peak value.

A preferred polymer comprises monomers selected from the group comprising monomers of formula (I) (Monomer A) and monomers of formula (IIa-IId) (Monomer B). The polymer comprises from 60 to 99%, preferably from 70 to 95% and especially from 80 to 90% by weight of at least one monoethylenically unsaturated polyalkylene oxide monomer of the formula (I) (monomer A)

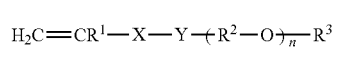

I wherein Y of formula (I) is selected from —O— and —NH—; if Y of formula (I) is —O—, X of formula (I) is selected from —$CH_2$— or —CO—, if Y of formula (I) is —NH—, X of formula (I) is —CO—; $R^1$ of formula (I) is selected from hydrogen, methyl, and mixtures thereof; $R^2$ of formula (I) is independently selected from linear or branched $C_2$-$C_6$-alkylene radicals, which may be arranged blockwise or randomly; $R^3$ of formula (I) is selected from hydrogen, $C_1$-$C_4$-alkyl, and mixtures thereof; n of formula (I) is an integer from 5 to 100, preferably from 10 to 70 and more preferably from 20 to 60.

The polymer comprises from 1 to 40%, preferably from 2 to 30% and especially from 5 to 25% by weight of at least one quaternized nitrogen-containing monoethylenically unsaturated monomer of formula (IIa-IId) (monomer B).

IIa

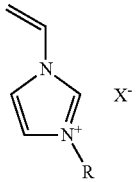

-continued

IIb

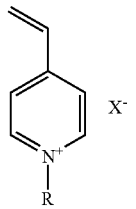

IIc

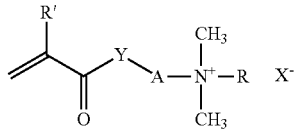

IId

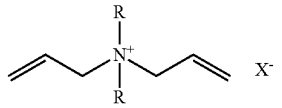

The monomers are selected such that the polymer has a weight average molecular weight ($M_w$) of from 20,000 to 500,000 g/mol, preferably from greater than 25,000 to 250,000 g/mol and especially from 30,000 to 200,000 g/mol.

The polymer preferably has a net positive charge when dissolved in an aqueous solution with a pH of 5 or above.

The polymer may further comprise monomers C and/or D. Monomer C may comprise from 0% to 15%, preferably from 0 to 10% and especially from 1 to 7% by weight of the polymer of an anionic monoethylenically unsaturated monomer.

Monomer D may comprise from 0% to 40%, preferably from 1 to 30% and especially from 5 to 20% by weight of the polymer of other non-ionic monoethylenically unsaturated monomers.

Preferred polymers for use in the particle of the invention comprise, as polymerized Monomer A, monoethylenically unsaturated polyalkylene oxide monomers of formula (I) in which Y of formula (I) is —O—; X of formula (I) is —CO—; $R^1$ of formula (I) is hydrogen or methyl; $R^2$ of formula (I) is independently selected from linear or branched $C_2$-$C_4$-alkylene radicals arranged blockwise or randomly, preferably ethylene, 1,2- or 1,3-propylene or mixtures thereof, particularly preferably ethylene; $R^3$ of formula (I) is methyl; and n is an integer from 5 to 100.

Monomer A

A monomer A may be, for example:

(a) reaction products of (meth)acrylic acid with polyalkylene glycols which are not terminally capped, terminally capped at one end by alkyl radicals; and (b) alkenyl ethers of polyalkylene glycols which are not terminally capped or terminally capped at one end by alkyl radicals.

Preferred monomer A is the (meth)acrylates and the allyl ethers, where the acrylates and primarily the methacrylates are particularly preferred. Particularly suitable examples of the monomer A are:

(a) methylpolyethylene glycol (meth)acrylate and (meth) acrylamide, methylpolypropylene glycol (meth)acrylate and (meth)acrylamide, methylpolybutylene glycol (meth)acrylate and (meth)acrylamide, methylpoly(propylene oxide-co-ethylene oxide) (meth)acrylate and (meth)acrylamide, ethylpolyethylene glycol (meth) acrylate and (meth)acrylamide, ethylpolypropylene glycol (meth)acrylate and (meth)acrylamide, ethylpolybutylene glycol (meth)acrylate and (meth)acrylamide and ethylpoly(propylene oxide-co-ethylene oxide) (meth)acrylate and (meth)acrylamide, each with 5 to 100, preferably 10 to 70 and particularly preferably 20 to 60, alkylene oxide units, where methylpolyethylene glycol acrylate is preferred and methylpolyethylene glycol methacrylate is particularly preferred;

(b) ethylene glycol allyl ethers and methylethylene glycol allyl ethers, propylene glycol allyl ethers and methylpropylene glycol allyl ethers each with 5 to 100, preferably 10 to 70 and particularly preferably 20 to 60, alkylene oxide units.

The proportion of Monomer A in the polymer is 60% to 99% by weight, preferably 70% to 95%, more preferably from 75% to 90% by weight of the polymer.

Monomer B

A monomer B that is particularly suitable includes the quaternization products of 1-vinylimidazoles, of vinylpyridines, of (meth)acrylic esters with amino alcohols, in particular N,N-di-$C_1$-$C_4$-alkylamino-$C_2$-$C_6$-alcohols, of amino-containing (meth)acrylamides, in particular N,N-di-$C_1$-$C_4$-alkyl-amino-$C_2$-$C_6$-alkylamides of (meth)acrylic acid, and of diallylalkylamines, in particular diallyl-$C_1$-$C_4$-alkylamines.

Suitable monomers B have the formula IIa to IId:

IIa

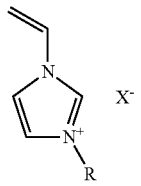

IIb

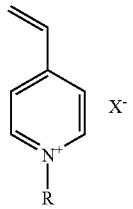

IIc

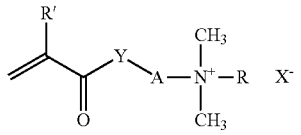

IId

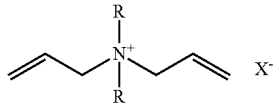

wherein R of formula IIa to IId is selected from $C_1$-$C_4$-alkyl or benzyl, preferably methyl, ethyl or benzyl; R' of formula IIc is selected from hydrogen or methyl; Y of formula IIc is selected from —O— or —NH—; A of formula IIc is selected from $C_1$-$C_6$-alkylene, preferably straight-chain or branched $C_2$-$C_4$-alkylene, in particular 1,2-ethylene, 1,3- and 1,2-propylene or 1,4-butylene; X— of formula IIa to IId is selected from halide, such as iodide and preferably chloride or bromide, $C_1$-$C_4$-alkyl sulfate, preferably methyl sulfate or ethyl sulfate, $C_1$-$C_4$-alkylsulfonate, preferably methylsulfonate or ethylsulfonate, $C_1$-$C_4$-alkyl carbonate; and mixtures thereof.

Specific examples of preferred monomer B that may be utilized are:

(a) 3-methyl-1-vinylimidazolium chloride, 3-methyl-1-vinylimidazolium methyl sulfate, 3-ethyl-1-vinylimidazolium ethyl sulfate, 3-ethyl-1-vinylimidazolium chloride and 3-benzyl-1-vinylimidazolium chloride;

(b) 1-methyl-4-vinylpyridinium chloride, 1-methyl-4-vinylpyridinium methyl sulfate and 1-benzyl-4-vinylpyridinium chloride;

(c) 3-methacrylamido-N,N,N-trimethylpropan-1-aminium chloride, 3-acryl-N,N,N-trimethylpropan-1-aminium chloride, 3-acryl-N,N,N-trimethylpropan-1-aminium methylsulfate, 3-methacryl-N,N,N-trimethylpropan-1-aminium chloride, 3-methacryl-N,N,N-trimethylpropan-1-aminium methylsulfate, 2-acrylamido-N,N,N-trimethylethan-1-aminium chloride, 2-acryl-N,N,N-trimethylethan-1-aminium chloride, 2-acryl-N,N,N-trimethylethan-1-aminium methyl sulfate, 2-methacryl-N,N,N-trimethylethan-1-aminium chloride, 2-methacryl-N,N,N-trimethylethan-1-aminium methyl sulfate, 2-acryl-N,N-dimethyl-N-ethylethan-1-aminium ethylsulfate, 2-methacryl-N,N-dimethyl-N-ethylethan-1-aminium ethylsulfate, and (d) dimethyldiallylammonium chloride and diethyldiallylammonium chloride.

A preferred monomer B is selected from 3-methyl-1-vinylimidazolium chloride, 3-methyl-1-vinylimidazolium methyl sulfate, 3-methacryl-N,N,N-trimethylpropan-1-aminium chloride, 2-methacryl-N,N,N-trimethylethan-1-aminium chloride, 2-methacryl-N,N-dimethyl-N-ethylethan-1-aminium ethylsulfate, and dimethyldiallylammonium chloride.

The polymer comprises 1% to 40% by weight, preferably 2% to 30%, and especially preferable from 5 to 20% by weight of the polymer, of Monomer B. The weight ratio of Monomer A to Monomer B is preferably equal to or greater than 2:1, preferably from 3:1 to 5:1.

Monomer C

As optional components of the polymer of the present invention, monomers C and D may also be utilized. Monomer C is selected from anionic monoethylenically unsaturated monomers. Suitable monomer C may be selected from:

(a) α,β-unsaturated monocarboxylic acids which preferably have 3 to 6 carbon atoms, such as acrylic acid, methacrylic acid, 2-methylenebutanoic acid, crotonic acid and vinylacetic acid, preference being given to acrylic acid and methacrylic acid;

(b) unsaturated dicarboxylic acids, which preferably have 4 to 6 carbon atoms, such as itaconic acid and maleic acid, anhydrides thereof, such as maleic anhydride;

(c) ethylenically unsaturated sulfonic acids, such as vinylsulfonic acid, acrylamidopropanesulfonic acid, methallylsulfonic acid, methacrylsulfonic acid, m- and p-styrenesulfonic acid, (meth)acrylamidomethanesulfonic acid, (meth)acrylamidoethanesulfonic acid, (meth)acrylamidopropanesulfonic acid, 2-(meth)acrylamido-2-methylpropanesulfonic acid, 2-acrylamido-2-butanesulfonic acid, 3-methacrylamido-2-hydroxypropanesulfonic acid, methanesulfonic acid acrylate, ethanesulfonic acid acrylate, propanesulfonic acid acrylate, allyloxybenzenesulfonic acid, methallyloxybenzenesulfonic acid and 1-allyloxy-2-hydroxypropanesulfonic acid; and (d) ethylenically unsaturated phosphonic acids, such as vinylphosphonic acid and m- and p-styrenephosphonic acid.

The anionic Monomer C can be present in the form of water soluble free acids or in water-soluble salt form, especially in the form of alkali metal and ammonium, in particular alkylammonium, salts, and preferred salts being the sodium salts.

A preferred Monomer C may be selected from acrylic acid, methacrylic acid, maleic acid, vinylsulfonic acid, 2-(meth)acrylamido-2-methylpropanesulfonic acid and vinylphosphonic acid, particular preference being given to acrylic acid, methacrylic acid and 2-acrylamido-2-methylpropanesulfonic acid.

The proportion of monomer C in the polymer can be up to 15% by weight, preferably from 1% to 5% by weight of the polymer.

If monomer C is present in the polymer, then, the molar ratio of monomer B to monomer C is greater than 1. The weight ratio of Monomer A to monomer C is preferably equal to or greater than 4:1, more preferably equal to or greater than 5:1. Additionally, the weight ratio of monomer B to monomer C is equal or greater than 2:1, and even more preferable from 2.5:1 to less than 20:1. Polymers having these ratios may impart effective levels of surface modification to reduce or decrease spotting and provide shiny surfaces.

Monomer D

As an optional component of the polymer, monomer D may also be utilized. Monomer D is selected from nonionic monoethylenically unsaturated monomers selected from:

(a) esters of monoethylenically unsaturated $C_3$-$C_6$-carboxylic acids, especially acrylic acid and methacrylic acid, with monohydric $C_1$-$C_{22}$-alcohols, in particular $C_1$-$C_{16}$-alcohols; and hydroxyalkyl esters of monoethylenically unsaturated $C_3$-$C_6$-carboyxlic acids, especially acrylic acid and methacrylic acid, with divalent $C_2$-$C_4$-alcohols, such as methyl (meth)acrylate, ethyl (meth)acrylate, n-butyl (meth)acrylate, sec-butyl (meth)acrylate, tert-butyl (meth)acrylate, ethylhexyl (meth)acrylate, decyl (meth)acrylate, lauryl (meth) acrylate, isobornyl (meth)acrylate, cetyl (meth)acrylate, palmityl (meth)acrylate and stearyl (meth)acrylate, hydroxyethyl (meth)acrylate, hydroxypropyl (meth)acrylate and hydroxybutyl (meth)acrylate;

(b) amides of monoethylenically unsaturated $C_3$-$C_6$-carboxylic acids, especially acrylic acid and methacrylic acid, with $C_1$-$C_{12}$-alkylamines and di($C_1$-$C_4$-alkyl) amines, such as N-methyl(meth)acrylamide, N,N-dimethyl(meth)acrylamide, N-ethyl(meth)acrylamide, N-propyl(meth)acrylamide, N-tert-butyl(meth)acrylamide, N-tert-octyl(meth)acrylamide and N-undecyl (meth)acrylamide, and (meth)acrylamide;

(c) vinyl esters of saturated $C_2$-$C_{30}$-carboxylic acids, in particular $C_2$-$C_{14}$-carboxylic acids, such as vinyl acetate, vinyl propionate, vinyl butyrate, vinyl 2-ethylhexanoate and vinyl laurate;

(d) vinyl $C_1$-$C_{30}$-alkyl ethers, in particular vinyl $C_1$-$C_{18}$-alkyl ethers, such as vinyl methyl ether, vinyl ethyl ether, vinyl n-propyl ether, vinyl isopropyl ether, vinyl n-butyl ether, vinyl isobutyl ether, vinyl 2-ethylhexyl ether and vinyl octadecyl ether, (e) N-vinylamides and N-vinyllactams, such as N-vinylformamide, N-vinyl-N-methyl-formamide, N-vinylacetamide, N-vinyl-N-methylacetamide, N-vinylimidazol, N-vinylpyrrolidone, N-vinylpiperidone and N-vinylcaprolactam;

(f) aliphatic and aromatic olefins, such as ethylene, propylene, $C_4$-$C_{24}$-α-olefins, in particular $C_4$-$C_{16}$-α-olefins, e.g. butylene, isobutylene, diisobutene, styrene and α-methylstyrene, and also diolefins with an active double bond, e.g. butadiene;

(g) unsaturated nitriles, such as acrylonitrile and methacrylonitrile.

A preferred monomer D is selected from methyl (meth) acrylate, ethyl (meth)acrylate, (meth)acrylamide, vinyl acetate, vinyl propionate, vinyl methyl ether, N-vinylformamide, N-vinylpyrrolidone, N-vinylimidazole and N-vinylcaprolactam. N-vinylimidazol is particularly preferred.

If the monomer D is present in the polymer, then the proportion of monomer D may be up to 40%, preferably from 1% to 30%, more preferably from 5% to 20% by weight of the polymer.

Preferred polymers of the present invention include:

Polymer 1

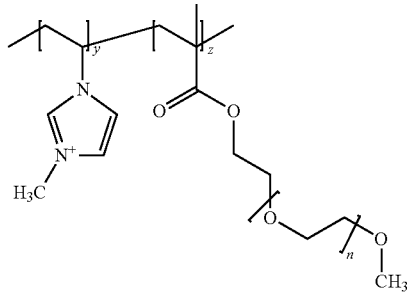

Polymer 2

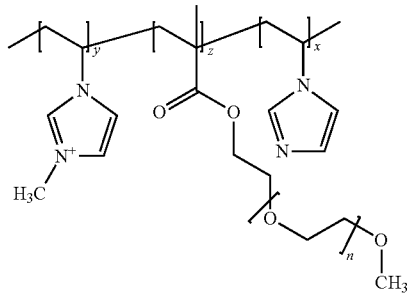

wherein indices y and z are such that the monomer ratio (z:y) is from 3:1 to 20:1 and the indices x and z are such that the monomer ratio (z:x) is from 1.5:1 to 20:1, and the polymer has a weight average molecular weight of from 20,000 to 500,000 g/mol, preferably from greater than 25,000 to 250,000 g/mol and especially from 30,000 to 200,000 g/mol.

These polymers can be prepared by free-radical polymerization of the Monomers A and B and if desired C and/or D. The free-radical polymerization of the monomers can be carried out in accordance with all known methods, preference being given to the processes of solution polymerization and of emulsion polymerization. Suitable polymerization initiators are compounds which decompose thermally or photochemically (photoinitiators) to form free radicals, such as benzophenone, acetophenone, benzoin ether, benzyl dialkyl ketones and derivatives thereof.

The polymerization initiators are used according to the requirements of the material to be polymerized, usually in amounts of from 0.01% to 15%, preferably 0.5% to 5% by weight based on the monomers to be polymerized, and can be used individually or in combination with one another.

Instead of a quaternized Monomer B, it is also possible to use the corresponding tertiary amines. In this case, the quaternization is carried out after the polymerization by reacting the resulting copolymer with alkylating agents, such as alkyl halides, dialkyl sulfates and dialkyl carbonates, or benzyl halides, such as benzyl chloride. Examples of suitable alkylating agents which may be mentioned are, methyl chloride, bromide and iodide, ethyl chloride and bromide, dimethyl sulfate, diethyl sulfate, dimethyl carbonate and diethyl carbonate.

The anionic monomer C can be used in the polymerization either in the form of the free acids or in a form partially or completely neutralized with bases. Specific examples that may be listed are: sodium hydroxide solution, potassium hydroxide solution, sodium carbonate, sodium hydrogen carbonate, ethanolamine, diethanolamine and triethanolamine.

To limit the molar masses of the polymers, customary regulators can be added during the polymerization, e.g. mercapto compounds, such as mercaptoethanol, thioglycolic acid and sodium disulfite. Suitable amounts of regulator are 0.1% to 5% by weight based on the monomers to be polymerized.

Other preferred polymers may comprise combinations of Monomers B, C and D, where the molar percent of monomer B is higher than the molar content of monomer C, rendering a net positive charge to the polymer.

Preferred polymers for use herein are those comprising methylpolyethylene glycol (meth)acrylate as monomer A. Also preferred polymers for use herein are those comprising a salt of 3-methyl-1-vinylimidazolium as monomer B. Especially preferred polymers for use herein comprises methylpolyethylene glycol (meth)acrylate as monomer A and a salt of 3-methyl-1-vinylimidazolium as monomer B. More preferably the polymer comprises from 70 to 80% by weight of the polymer of methylpolyethylene glycol (meth)acrylate and from 10 to 30% by weight of the polymer of a salt of 3-methyl-1-vinylimidazolium. These polymers have been found to reduce the number of spots and filming on washed surfaces leaving the surfaces shiny.

There are also preferred surface-modification surface-substantive polymers comprising methylpolyethylene glycol (meth)acrylate as monomer A, a salt of 3-methyl-1-vinylimidazolium as monomer B and N-vinylimidazole as monomer D.

Preferred copolymers are those in which the ethylene glycol unit is repeated from 3 to 100, more preferably from 10 to 80 and especially from 15 to 50.

The polymer of the invention can act as a surface modification polymer and can provide anti-spotting benefits in automatic dishwashing.

The particle of the invention is a high active particle, i.e. has a high level of polymer. This makes it suitable for use in concentrated cleaning composition and compositions in unit dose form. The polymer is present in the particle of the invention in a level of from about 30 to 70%, preferably from 40% to 60% by weight of the particle.

First Material

The particle of the invention comprises from 20 to 60%, preferably from 30 to 50% by weight of the particle of a first material. The first material has a high surface area that allows the material to load a high amount of polymer.

Preferably, the first material is silica, more preferably hydrophilic silica. Upon hydration, hydrophilic silica can form swollen hydrogel particles of significantly larger sizes, thereby facilitating faster dispersion and dissolution of the particles into the polymer.

The hydrophilic silica is provided in a dry powder form, which has relatively small dry particle size and low residue salt content. Specifically, the silica particles have a dry particle size distribution D50 ranging from about 5 μm to about 20 μm. The residual salt content in the hydrophilic silica is less than about 10%, preferably less than about 5%, more preferably less than about 2% or 1% by total weight of the silica. Most preferably, the hydrophilic silica is substantially free of any residue salt.

Amorphous synthetic silica can be manufactured using a thermal or pyrogenic or a wet process. The thermal process leads to fumed silica. The wet process to either precipitated silica or silica gels. Either fumed silica or precipitated silica can be used for practice of the present invention. The pH of the hydrophilic silica of the present invention is normally from about 5.5 to about 9.5, preferably from about 6.0 to about 7.0. Surface area of the hydrophilic silica is greater than 100 m2/g, preferably from greater than 100 to 500 $m^2/g$, more preferably from 125 to 300 $m^2/g$ and most preferably from 150 to 200 $m^2/g$, as measured by the BET nitrogen adsorption method.

Silica has both internal and external surface area, which allows for easy absorption of liquids. Hydrophilic silica is especially effective at adsorbing water. Swelling of dried hydrophilic silica upon contact with excess water to form hydrogel particles can be observed by optical microscopy and can be measured quantitatively using particle size analysis by comparing the particle size distribution of the fully hydrated material (i.e., in a dilute suspension) with that of the dried powder. Generally, precipitated hydrophilic silica can absorb water in excess of 2 times of its original weight, thereby forming swollen hydrogel particles having a Swollen Factor of at least 5, preferably at least 10, and more preferably at least 30. Therefore, the hydrophilic silica used in the present invention is preferably amorphous precipitated silica. A particularly preferred hydrophilic precipitated silica material for use herein is commercially available from Madhu.

In order to allow the silica particles to achieve maximum volumetric expansion upon hydration, it is preferred that the particles of the present invention contain little or no free water, e.g., preferably less than about 5%, more preferably less than about 4% and most preferably less than about 3% by weight of the particles. In this manner, the external and internal surfaces of the silica particles are substantially free of water or liquids, and the silica particles are in a substantially dry state and are therefore capable of undergoing subsequent expansion in volume when they come into contact with water during cleaning to facilitate disintegration of the particles and accelerate release of the polymer into water.

Surface Area Evaluation

The surface area is calculated using the Brunauer, Emmett and Teller (BET) Theory. The specific surface area of a powder in $m^2/g$ can be evaluated using gas adsorption by calculating the amount of adsorbate gas corresponding to a monomolecular layer on the substrate surface.

The BET equation is $$\frac{1}{\left[v_a\left(\frac{P_0}{P}-1\right)\right]}=\frac{C-1}{v_m C}\left(\frac{P}{P_0}\right)+\frac{1}{v_m C}$$

where P is the partial pressure of the adsorbate gas, $P_0$ the saturated pressure of the adsorbate gas, $v_a$ the volume of gas adsorbed at standard temperature and pressure, $v_m$ the volume of adsorbed gas and C a dimensionless constant. The above equation is an adsorption isotherm whereby $v_a$ is measured and plotted as a function of $P/P_0$. The resulting plot is known as a BET plot and a linear relationship obtained in the range of $0.05<P/P_0<0.35$. The gradient and the y-axis intercept are used to calculate the monolayer adsorbed quantity $v_m$ and the BET constant, C. The specific surface area, $S_{BET}$ is calculated using $$S_{BET} = \frac{V_m NS}{VM}$$

where N is Avogadro's constant, S the adsorption cross section of the adsorbing species, V the molar volume of the adsorbate gas and M the mass of the sample.

The surface area is determined using a Micrometrics gas sorption analyser. The sample mass is 0.5332 g, the analysis bath temperature is 77.278 K, the equilibration interval 10 s.

D50 for the first material can be measured using laser diffraction and ISO 13320-1 (2009 edition).

Second Material

The particle of the invention comprises from 3 to 15%, preferably from 5 to 12% by weight of the particle of a second material. The second material has a low surface area. The second material has a BET surface area from about 0.01 to about 5 m2/g, preferably from about 0.02 to about 1 m2/g. The surface area of the first material is calculated in an analogous manner to that described for the first material. The primary role of the second materials is to bind the highly polymer-loaded first material.

Preferably, the second material is a water-soluble alkaline metal sulfate. The water-soluble alkaline metal sulfates can be selected from the group consisting of sodium sulfate, potassium sulfate, sodium bisulfate, potassium bisulfate, and the like. Sodium sulfate is particularly preferred for use herein.

The second material is in a particulate form and is preferably characterized by a particle size distribution D50 ranging from about 30 microns to about 100 microns, more preferably from about 40 microns to about 90 microns, and most preferably from about 50 microns to about 80 microns. Preferably, the second material is sodium sulfate particles having Dw50 ranging from about 50 microns to about 80 microns in an amount ranging from about 5 to about 12% by weight of the particle.

Particle Size Measurement: Laser Diffraction Method

This test method must be used to determine a fine powder's (e.g. raw materials like silica and sodium sulfate) Weight Median Particle Size (D50). The fine powder's Weight Median Particle Size (D50) is determined in accordance with ISO 8130-13, "Coating powders—Part 13: Particle size analysis by laser diffraction." A suitable laser diffraction particle size analyzer with a dry-powder feeder can be obtained from Horiba Instruments Incorporated of Irvine, Calif., U.S.A.; Malvern Instruments Ltd of Worcestershire, UK; Sympatec GmbH of Clausthal-Zellerfeld, Germany; and Beckman-Coulter Incorporated of Fullerton, Calif., U.S.A.

The results are expressed in accordance with ISO 9276-1:1998, "Representation of results of particle size analysis—Part 1: Graphical Representation", Figure A.4, "Cumulative distribution Q3 plotted on graph paper with a logarithmic abscissa." The Median Particle Size is defined as the abscissa value at the point where the cumulative distribution (Q3) is equal to 50 percent.

Polycarboxylic Material

The particles of the invention can comprise a third material comprising one or more carboxylic groups. The third material is different from the polymer of the particles of the invention.

When the polymer of the invention comprises nitrogen atoms, the polymer can generate malodours either from by-products originating from the synthesis, from degradation or from interaction with other components in a cleaning composition. The third material provides malodour reduction.

Suitable materials for use as malodour reducing agents include monomeric or polymeric carboxylic acids, either in the form of the free acid or in partly neutralized form. In the context of the present invention, the term "acid" therefore includes both the acids in free form and in partly neutralized form. Preferably the acid should have a pH of less than 7 as measured in 1% weight aqueous solution in distilled water at 20° C. Preferred counterions are especially sodium ions. Preferred organic acids are citric acid, ascorbic acid, oxalic acid, adipic acid, succinic acid, glutaric acid, malic acid, tartaric acid, maleic acid, famaric acid, sugar acids, aminocarboxylic acids, fatty acids and mixtures thereof. Particularly preferred organic acids are oxalic acid, ascorbic acid, citric acid and fatty acids. The polymeric acids used herein can be polymers of acrylic acid and copolymers of acrylic acid with methacrylic acid and of acrylic acid or methacrylic acid with maleic acid. Especially preferred organic acids are citric acid, ascorbic acid and oxalic acid. Dispersant polymers discussed in more detail herein below are very suitable for use as malodour reducing agent. In particular carboxylic based sulfonated polymers.

Cleaning Composition

The particle of the invention is suitable for use in cleaning compositions, in particular powder compositions. Preferably, the composition of the invention is an automatic dishwashing composition.

The automatic dishwashing cleaning composition can be in the form of loose powder or presented in unit dose form. Preferably it is in unit dose form, unit dose forms include pressed tablets and water-soluble packs. The automatic dishwashing cleaning composition of the invention is preferably presented in unit-dose form. The composition of the invention is very well suited to be presented in the form of a multi-compartment pack, more in particular a multi-compartment pack comprising compartments with compositions in different physical forms, for example a compartment comprising a composition in solid form and another compartment comprising a composition in liquid form. The composition is preferably enveloped by a water-soluble film such as polyvinyl alcohol. Especially preferred are compositions in unit dose form wrapped in a polyvinyl alcohol film having a thickness of less than 100 μm. The detergent composition of the invention weighs from about 8 to about 25 grams, preferably from about 10 to about 20 grams. This weight range fits comfortably in a dishwasher dispenser. Even though this range amounts to a low amount of detergent, the detergent has been formulated in a way that provides all the benefits mentioned herein above.

The composition is preferably phosphate free. By "phosphate-free" is herein understood that the composition comprises less than 1%, preferably less than 0.1% by weight of the composition of phosphate.

Excellent cleaning and shine benefits are obtained with compositions comprising the particle of the invention. The particle delivers the polymer without leaving residues.

Preferably, the composition of the invention comprises a complexing agent. For the purpose of this invention a "complexing agent" is a compound capable of binding polyvalent ions such as calcium, magnesium, lead, copper, zinc, cadmium, mercury, manganese, iron, aluminium and other cationic polyvalent ions to form a water-soluble complex. The complexing agent has a logarithmic stability constant ([log K]) for Ca2+ of at least 5, preferably at least 6. The stability constant, log K, is measured in a solution of ionic strength of 0.1, at a temperature of 25° C. Preferably, the composition of the invention comprises an aminocarboxylated complexing agent, preferably selected from the group consisting of methyl-glycine-diacetic acid (MGDA), its salts and derivatives thereof, glutamic-N,N-diacetic acid (GLDA), its salts and derivatives thereof, iminodisuccinic acid (IDS), its salts and derivatives thereof, carboxy methyl inulin, its salts and derivatives thereof and mixtures thereof. Especially preferred complexing agent for use herein is selected from the group consisting of MGDA and salts thereof, especially preferred for use herein is the three sodium salt of MGDA. Preferably, the complexing agent is the three sodium salt of MGDA and the dispersant polymer is a sulfonated polymer, more preferably comprising 2-acrylamido-2-methylpropane sulfonic acid monomer.

Dispersant Polymer

A dispersant polymer can be used in addition to the polymer of the particle of the invention.

Suitable amounts of dispersant polymer range from about 0.1 to about 20%, preferably from 0.2 to about 15%, more preferably from 0.3 to % by weight of the composition.

The dispersant polymer is capable to suspend calcium or calcium carbonate in an automatic dishwashing process.

The dispersant polymer has a calcium binding capacity within the range between 30 to 250 mg of Ca/g of dispersant polymer, preferably between 35 to 200 mg of Ca/g of dispersant polymer, more preferably 40 to 150 mg of Ca/g of dispersant polymer at 25° C. In order to determine if a polymer is a dispersant polymer within the meaning of the invention, the following calcium binding-capacity determination is conducted in accordance with the following instructions:

Calcium Binding Capacity Test Method

The calcium binding capacity referred to herein is determined via titration using a pH/ion meter, such as the Meettler Toledo SevenMulti™ bench top meter and a PerfectION™ comb Ca combination electrode. To measure the binding capacity a heating and stirring device suitable for beakers or tergotometer pots is set to 25° C., and the ion electrode with meter are calibrated according to the manufacturer's instructions. The standard concentrations for the electrode calibration should bracket the test concentration and should be measured at 25° C. A stock solution of 1000 mg/g of Ca is prepared by adding 3.67 g of $CaCl_2$-$2H_2O$ into 1 L of deionised water, then dilutions are carried out to prepare three working solutions of 100 mL each, respectively comprising 100 mg/g, 10 mg/g, and 1 mg/g concentrations of Calcium. The 100 mg Ca/g working solution is used as the initial concentration during the titration, which is conducted at 25° C. The ionic strength of each working solution is adjusted by adding 2.5 g/L of NaCl to each. The 100 mL of 100 mg Ca/g working solution is heated and stirred until it reaches 25° C. The initial reading of Calcium ion concentration is conducted at when the solution reaches 25° C. using the ion electrode. Then the test polymer is added incrementally to the calcium working solution (at 0.01 g/L intervals) and measured after 5 minutes of agitation following each incremental addition. The titration is stopped when the solution reaches 1 mg/g of Calcium. The titration procedure is repeated using the remaining two calcium concentration working solutions. The binding capacity of the test polymer is calculated as the linear slope of the calcium concentrations measured against the grams/L of test polymer that was added.

The dispersant polymer preferably bears a negative net charge when dissolved in an aqueous solution with a pH greater than 6.

The dispersant polymer can bear also sulfonated carboxylic esters or amides, in order to increase the negative charge at lower pH and improve their dispersing properties in hard water. The preferred dispersant polymers are sulfonated/carboxylated polymers, i.e., polymer comprising both sulfonated and carboxylated monomers.

Preferably, the dispersant polymers are sulfonated derivatives of polycarboxylic acids and may comprise two, three, four or more different monomer units. The preferred copolymers contain:

At least one structural unit derived from a carboxylic acid monomer having the general formula (III):

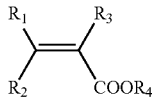

(III)

wherein $R_1$ to $R_3$ are independently selected from hydrogen, methyl, linear or branched saturated alkyl groups having from 2 to 12 carbon atoms, linear or branched mono or polyunsaturated alkenyl groups having from 2 to 12 carbon atoms, alkyl or alkenyl groups as aforementioned substituted with —NH2 or —OH, or —COOH, or $COOR_4$, where $R_4$ is selected from hydrogen, alkali metal, or a linear or branched, saturated or unsaturated alkyl or alkenyl group with 2 to 12 carbons;

Preferred carboxylic acid monomers include one or more of the following: acrylic acid, maleic acid, maleic anhydride, itaconic acid, citraconic acid, 2-phenylacrylic acid, cinnamic acid, crotonic acid, fumaric acid, methacrylic acid, 2-ethylacrylic acid, methylenemalonic acid, or sorbic acid. Acrylic and methacrylic acids being more preferred.

Optionally, one or more structural units derived from at least one nonionic monomer having the general formula (IV):

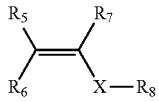

(IV)

Wherein $R_5$ to $R_7$ are independently selected from hydrogen, methyl, phenyl or hydroxyalkyl groups containing 1 to 6 carbon atoms, and can be part of a cyclic structure, X is an optionally present spacer group which is selected from —$CH_2$—, —COO—, —CONH— or —$CONR_8$—, and $R_8$ is selected from linear or branched, saturated alkyl radicals having 1 to 22 carbon atoms or unsaturated, preferably aromatic, radicals having from 6 to 22 carbon atoms.

Preferred non-ionic monomers include one or more of the following: butene, isobutene, pentene, 2-methylpent-1-ene, 3-methylpent-1-ene, 2,4,4-trimethylpent-1-ene, 2,4,4-trimethylpent-2-ene, cyclopentene, methylcyclopentene, 2-methyl-3-methyl-cyclopentene, hexene, 2,3-dimethylhex-1-ene, 2,4-dimethylhex-1-ene, 2,5-dimethylhex-1-ene, 3,5-dimethylhex-1-ene, 4,4-dimethylhex-1-ene, cyclohexene, methylcyclohexene, cycloheptene, alpha olefins having 10 or more carbon atoms such as, dec-1-ene, dodec-1-ene, hexadec-1-ene, octadec-1-ene and docos-1-ene, preferred aromatic monomers are styrene, alpha methylstyrene, 3-methylstyrene, 4-dodecylstyrene, 2-ethyl-4-bezylstyrene, 4-cyclohexylstyrene, 4-propylstyrol, 1-vinylnaphtalene, 2-vinylnaphtalene; preferred carboxylic ester monomers are methyl (meth)acrylate, ethyl (meth)acrylate, propyl (meth) acrylate, t-butyl (meth)acrylate, pentyl (meth)acrylate, hexyl (meth)acrylate, 2-ethylhexyl (meth)acrylate, octyl (meth) acrylate, lauryl (meth)acrylate, stearyl (meth)acrylate and behenyl (meth)acrylate; preferred amides are N-methyl acrylamide, N-ethyl acrylamide, N-t-butyl acrylamide, N-2-ethylhexyl acrylamide, N-octyl acrylamide, N-lauryl acrylamide, N-stearyl acrylamide, N-behenyl acrylamide.

and at least one structural unit derived from at least one sulfonic acid monomer having the general formula (V) and (VI):

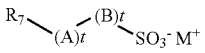

(V)

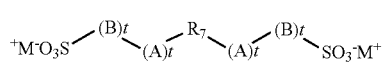

(VI)

wherein $R_7$ is a group comprising at least one sp2 bond, A is O, N, P, S, an amido or ester linkage, B is a mono- or polycyclic aromatic group or an aliphatic group, each t is independently 0 or 1, and M+ is a cation. In one aspect, $R_7$ is a C2 to C6 alkene. In another aspect, R7 is ethene, butene or propene.

Preferred sulfonated monomers include one or more of the following: 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxy-propanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propen-1-sulfonic acid, styrenesulfonic acid, vinylsulfonic acid, 3-sulfopropyl, 3-sulfo-propylmethacrylate, sulfomethacrylamide, sulfomethylmethacrylamide and mixtures of said acids or their water-soluble salts.

Preferably, the polymer comprises the following levels of monomers: from about 40 to about 90%, preferably from about 60 to about 90% by weight of the polymer of one or more carboxylic acid monomer, from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

The carboxylic acid is preferably (meth)acrylic acid. The sulfonic acid monomer is preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

Suitable dispersant polymers include anionic carboxylic polymer of low molecular weight. They can be homopolymers or copolymers with a weight average molecular weight of less than or equal to about 200,000 g/mol, or less than or equal to about 75,000 g/mol, or less than or equal to about 50,000 g/mol, or from about 3,000 to about 50,000 g/mol, preferably from about 5,000 to about 45,000 g/mol. The dispersant polymer may be a low molecular weight homopolymer of polyacrylate, with an average molecular weight of from 1,000 to 20,000, particularly from 2,000 to 10,000, and particularly preferably from 3,000 to 5,000.

The dispersant polymer may be a copolymer of acrylic with methacrylic acid, acrylic and/or methacrylic with maleic acid, and acrylic and/or methacrylic with fumaric acid, with a molecular weight of less than 70,000. Their molecular weight ranges from 2,000 to 80,000 and more preferably from 20,000 to 50,000 and in particular 30,000 to 40,000 g/mol. and a ratio of (meth)acrylate to maleate or fumarate segments of from 30:1 to 1:2.

The dispersant polymer may be a copolymer of acrylamide and acrylate having a molecular weight of from 3,000 to 100,000, alternatively from 4,000 to 20,000, and an acrylamide content of less than 50%, alternatively less than 20%, by weight of the dispersant polymer can also be used. Alternatively, such dispersant polymer may have a molecular weight of from 4,000 to 20,000 and an acrylamide content of from 0% to 15%, by weight of the polymer.

Dispersant polymers suitable herein also include itaconic acid homopolymers and copolymers.

Alternatively, the dispersant polymer can be selected from the group consisting of alkoxylated polyalkyleneimines, alkoxylated polycarboxylates, polyethylene glycols, styrene co-polymers, cellulose sulfate esters, carboxylated polysaccharides, amphiphilic graft copolymers and mixtures thereof.

Bleach

The composition of the invention preferably comprises from about 1 to about 20%, more preferably from about 5 to about 18%, even more preferably from about 8 to about 15% of bleach by weight of the composition.

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially dodecanediperoxoic acid, tetradecanediperoxoic acid, and hexadecanediperoxoic acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the composition of the invention comprises from 0.01 to 5, preferably from 0.2 to 2% by weight of the composition of bleach activator, preferably TAED.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include manganese triazacyclononane and related complexes; Co, Cu, Mn and Fe bispyridylamine and related complexes; and pentamine acetate cobalt(III) and related complexes.

Preferably the composition of the invention comprises from 0.001 to 0.5, more preferably from 0.002 to 0.05% of bleach catalyst by weight of the composition. Preferably the bleach catalyst is a manganese bleach catalyst.

Inorganic Builder

The composition of the invention preferably comprises an inorganic builder. Suitable inorganic builders are selected from the group consisting of carbonate, silicate and mixtures thereof. Especially preferred for use herein is sodium carbonate. Preferably the composition of the invention comprises from 5 to 50%, more preferably from 10 to 40% and especially from 15 to 30% of sodium carbonate by weight of the composition.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]_x[CH2CH2O]_y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH) R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Enzymes

In describing enzyme variants herein, the following nomenclature is used for ease of reference: Original amino acid(s):position(s):substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference: V68A, N87S, S99D, S99SD, S99A, S101G, S101M, S103A, V104N/I, G118V, G118R, S128L, P129Q, S130A, Y167A, R170S, A194P, V205I and/or M222S.

Most preferably the protease is selected from the group comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

(i) G118V+S128L+P129Q+S130A (ii) S101M+G118V+S128L+P129Q+S130A (iii) N76D+N87R+GI 18R+S128L+P129Q+S130A+S188D+N248R (iv) N76D+N87R+GI 18R+S128L+P129Q+S130A+S188D+V244R (v) N76D+N87R+G118R+S128L+P129Q+S130A (vi) V68A+N87S+S101G+V104N Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the product of the invention include from about 0.1 to about 10, more preferably from about 0.5 to about 7 and especially from about 1 to about 6 mg of active protease.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334).

Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp. 707 (SEQ ID NO:7 in U.S. Pat. No. 6,093,562), especially those comprising one or more of the following mutations M202, M208, S255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Preferably, the product of the invention comprises at least 0.01 mg, preferably from about 0.05 to about 10, more preferably from about 0.1 to about 6, especially from about 0.2 to about 5 mg of active amylase.

Preferably, the protease and/or amylase of the product of the invention are in the form of granulates, the granulates comprise less than 29% of sodium sulfate by weight of the granulate or the sodium sulfate and the active enzyme (protease and/or amylase) are in a weight ratio of less than 4:1.

Crystal Growth Inhibitor

Crystal growth inhibitors are materials that can bind to calcium carbonate crystals and prevent further growth of species such as aragonite and calcite.

Especially preferred crystal growth inhibitor for use herein is HEDP (1-hydroxyethylidene 1,1-diphosphonic acid). Preferably, the composition of the invention comprises from 0.01 to 5%, more preferably from 0.05 to 3% and especially from 0.5 to 2% of a crystal growth inhibitor by weight of the product, preferably HEDP.

Metal Care Agents

Metal care agents may prevent or reduce the tarnishing, corrosion or oxidation of metals, including aluminium, stainless steel and non-ferrous metals, such as silver and copper. Preferably the composition of the invention comprises from 0.1 to 5%, more preferably from 0.2 to 4% and especially from 0.3 to 3% by weight of the product of a metal care agent, preferably the metal care agent is benzo triazole (BTA).

Glass Care Agents

Glass care agents protect the appearance of glass items during the dishwashing process. Preferably the composition of the invention comprises from 0.1 to 5%, more preferably from 0.2 to 4% and specially from 0.3 to 3% by weight of the composition of a metal care agent, preferably the glass care agent is a zinc containing material, specially hydrozincite.

The automatic dishwashing composition of the invention preferably has a pH as measured in 1% weight/volume aqueous solution in distilled water at 20° C. of from about 9 to about 12, more preferably from about 10 to less than about 11.5 and especially from about 10.5 to about 11.5.

The automatic dishwashing composition of the invention preferably has a reserve alkalinity of from about 10 to about 20, more preferably from about 12 to about 18 at a pH of 9.5 as measured in NaOH with 100 grams of product at 20° C.

A preferred automatic dishwashing composition of the invention include:

i) from 2 to 10% by weight of the composition of bleach, preferably sodium percarbonate;
ii) preferably a bleach activator, more preferably TAED;
iii) enzymes, preferably amylases and proteases;
iv) optionally but preferably from 5 to 30% by weight of the composition of an inorganic builder, preferably sodium carbonate;
v) optionally but preferably from 2 to 10% by weight of the composition of a non-ionic surfactant;
vi) optionally but preferably a bleach catalyst, more preferably a manganese bleach catalyst;
vii) other optional ingredients include: a crystal growth inhibitor, preferably HEDP, and glass care agents.

Process for Making the Particle

The process for making the particle of the invention, preferably in an agglomerated form, comprises the steps of: a) providing the first and second materials in the weight proportions defined hereinabove, the first material is preferably silica and the second material is preferably sulfate; b) adding the polymer in the form of an aqueous solution to the mixture resulting from step a). The materials are preferably mixed in a mixer or granulator that is operating at a suitable shear force for agglomeration of the raw materials; c) optionally, removing any oversize particles, which are recycled via a grinder or lump-breaker back into the process stream, e.g., into step a) or b); d) the resulting agglomerates are dried to remove moisture that may be present in excess of 3 wt %, preferably in excess of 2%, and more preferably in excess of 1%; e) optionally, removing any fines and recycling the fines to the mixer-granulator, as described in step c); and f) optionally, further removing any dried oversize agglomerates and recycling via a grinder to step a) or e).

Any suitable mixing apparatus capable of handling a viscous paste can be used as the mixer in the process of the invention. Suitable apparatus includes, for example, high-speed pin mixers, ploughshare mixers, paddle mixers, twin-screw extruders, Teledyne compounders, etc. The mixing process can either be carried out intermittently in batches or continuously. The drying preferably takes place in a fluidized bed.

EXAMPLES

To exemplify the invention the following particles were made:

Particle A 96 g of precipitated silica (D50 10-12 μm supplied by Madhu) and 16 g of commercially available sodium sulphate, previously ground to a particle size of 60 m were added into a Kenwood mixer and blend together at full speed. While mixing, 300 g of a 40% active aqueous solution of the polymer (MPEG-MA (methyl polyethyleneglycol methacrylate) with 45 EO (ethylene oxide) and 20% wt QVI (3-methyl-1-vinylimidazolium), supplied by BASF) were injected onto the powder bed, until a granular product was obtained, referred herein after as wet agglomerate.

The wet agglomerate was then dried using a Sherwood fluidized bed (max 2 kg capacity) for 15 minutes at 120° C. To measure the water content of the final agglomerate, approximately 2 g of the dried agglomerate were then placed in a Mettler Infrared Moisture equipment for 2 minutes at 160° C. The target moisture of the dry agglomerate was less than 5%.

| Percent weight | Wet agglomerate composition | Dry Agglomerate composition |
|---|---|---|
| Polymer (MPEG-MA/QVI) | 30 | 50 |
| Silica | 23 | 39 |
| Sodium Sulphate | 4 | 6 |
| Water | 43 | 5 |

Example Particle B 576 g of precipitated silica (D50 10-12 μm supplied by Madhu) and 80 g of commercially available sodium sulphate, previously ground to a particle size of 60 μm, and 1500 g of a 40% active aqueous solution of the polymer (MPEG-MA (methyl polyethyleneglycol methacrylate) with 45 EO (ethylene oxide) and 20% wt QVI (3-methyl-1-vinylimidazolium), supplied by BASF) were added into a Comasa mixer and blend together using 250 rpm impeller speed and 300 rpm chopper speed for 3 minutes to form the wet agglomerate.

The wet agglomerate was then dried using a Niro fluidized bed (max 5 kg capacity) for 15 minutes at 120° C. To measure the water content the agglomerate, approximately 2 g of the dried agglomerate were then placed in Mettler Infrared Moisture equipment for 2 minutes at 160° C. The target moisture of the dry agglomerate was less than 5%.

| Percent weight | Wet agglomerate composition | Dry Agglomerate composition |
|---|---|---|
| Polymer (MPEG-MA/QVI) | 30 | 50 |
| Silica | 23 | 39 |
| Sodium Sulphate | 4 | 6 |
| Water | 43 | 5 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A cleaning composition comprising a particle said particle comprising:

(a) from about 40 to about 60% by weight thereof of a polymer comprising from about 69 to about 89% of methylpolyethylene glycol (meth)acrylate and from about 9 to about 29% of a salt of 3-methyl-1-vinylimidazolium;

(b) from about 40 to about 50% by weight thereof of a silica having a BET surface area greater than 100 m2/g and a D50 from about 5 to about 20 μm;

(c) from about 4 wt % to about 10% by weight thereof of a sulfate having a BET surface area from about 0.01 to about 5 m2/g and a D50 from about 50 to about 80 μm; and (d) citric acid, wherein the residual salt in the silica is less than about 2%, by total weight of the silica.

2. A composition according to claim 1 wherein the composition is an automatic dishwashing composition.

3. A composition according to claim 1 wherein the composition or part thereof is in powder form.

4. A process for making a composition according to claim 1 said process comprising the steps of making the particle by:

a) admixing the silica and the sulfate materials;

b) adding the polymer in the form of an aqueous solution to the mixture resulting from step a);

c) drying the mixture resulting from step b); and d) adding the particle to the remaining components of the composition.

5. A process for making a composition according to claim 1 said process comprising the steps of making the particle by:

a) admixing the silica and the sulfate materials;

b) adding the polymer in the form of an aqueous solution to the mixture resulting from step a) wherein the aqueous solution comprises from about 20% to about 50% by weight of the solution of the polymer;

c) drying the mixture resulting from step b); and d) adding the particle to the remaining components of the composition.

6. A process for making a composition according to claim 1 wherein the particle is made by agglomeration.

7. A process for making a composition according to claim 1 said process comprising the steps of making the particle by:

a) admixing the silica and the sulfate materials;

b) adding the polymer in the form of an aqueous solution to the mixture resulting from step a);

c) drying the mixture resulting from step b) in a fluidized bed; and d) adding the particle to the remaining components of the composition.

* * * * *